US007267093B2

(12) United States Patent
Huster et al.

(10) Patent No.: US 7,267,093 B2
(45) Date of Patent: Sep. 11, 2007

(54) CRANKCASE WITH BOTTOM PLATE

(75) Inventors: Joachim Huster, Feiedrichshafen (DE); Dagmar Neu, Bermatingen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 11/475,507

(22) Filed: Jun. 27, 2006

(65) Prior Publication Data

US 2007/0000471 A1 Jan. 4, 2007

(30) Foreign Application Priority Data

Jul. 1, 2005 (DE) ..... 10 2005 030 850

(51) Int. Cl.
*F01M 1/12* (2006.01)

(52) U.S. Cl. ..... 123/196 R

(58) Field of Classification Search ..... 123/196 R, 123/657, 41.86, 73 R, 73 AF
See application file for complete search history.

(56) References Cited

U.S. PATENT DOCUMENTS 4,373,336 A * 2/1983 Horler et al. ..... 60/606
5,103,782 A * 4/1992 Matsui ..... 123/195 C
5,601,060 A * 2/1997 Smietanski et al. ..... 123/195 C
6,328,004 B1 * 12/2001 Rynhart ..... 123/73 AF
7,036,479 B2 * 5/2006 Takenaka et al. ..... 123/193.2
7,124,730 B2 * 10/2006 Schwarzl et al. ..... 123/196 R
2003/0000495 A1 * 1/2003 Groddeck et al. ..... 123/195 C
2003/0140887 A1 * 7/2003 Rosendahl et al. ..... 123/195 C
2005/0257766 A1 * 11/2005 Rau et al. ..... 123/195 C
2006/0118070 A1 * 6/2006 Branston ..... 123/73 AF
2006/0124084 A1 * 6/2006 Hofbauer et al. ..... 123/55.7
2006/0213476 A1 * 9/2006 Ruetz ..... 123/195 C
2006/0283418 A1 * 12/2006 Matsuda et al. ..... 123/197.1
2006/0288976 A1 * 12/2006 Watanabe ..... 123/196 R
2007/0000478 A1 * 1/2007 Sadakane et al. ..... 123/431

FOREIGN PATENT DOCUMENTS

DE 2 140 377 2/1973

* cited by examiner

*Primary Examiner*—Willis R. Wolfe
*Assistant Examiner*—Jason Benton
(74) *Attorney, Agent, or Firm*—Klaus J. Bach

(57) ABSTRACT

In a crankcase for an internal combustion engine, including a lubricant chamber for the collection of lubricant, and a bottom plate for providing dry sump lubrication closing the crankcase and being sealingly joined to the bottom end of the crankcase, wherein the crankcase includes auxiliary equipment comprising pumps for pumping lubricant into the lubricant chamber and from the lubricant chamber to various lubrication points, the bottom plate has a width exceeding the width of the crankcase so that it forms a section which is disposed outside the crankcase and auxiliary equipment is disposed on this section outside the crankcase.

10 Claims, 2 Drawing Sheets

CRANKCASE WITH BOTTOM PLATE

BACKGROUND OF THE INVENTION

The present invention resides in a crankcase for an internal combustion engine with in-line cylinder arrangement, including a chamber for collecting lubricant which is arranged within the crankcase, and with a bottom plate for providing dry sump lubrication, which bottom plate closes the crankcase to the ambient.

DE 21 40 377 A discloses a crankcase for an internal combustion engine with in-line cylinder arrangement wherein a side-wall of the crankcase is provided at the side of the cylinders in the form of a chamber. Toward the ambient, the crankcase is closed at the bottom by an oil pan. From the oil pan, a suction pump pumps the lubricant into the chamber whereby a dry-sump lubrication system is provided. The cylinder head includes several channels by which the cylinder head is in communication with the chamber. The lubricant flowing back from the lubricating locations of the cylinder head is conducted directly into the chamber while bypassing the dry sump. To this end, the crankcase must be inclined in the area of the cylinder and the cylinder head with respect to a horizontal plane. The crankcase is therefore wider than a crankcase of an engine with vertical cylinders. Since, in practice, the available construction space and the power output of the engine is given to the manufacturer by the final customer, the inclined crankcase causes a target conflict between the two requirements.

It is the object of the present invention to provide a crankcase for an engine with vertical cylinders including a bottom plate all with an optimal space utilization.

SUMMARY OF THE INVENTION

In a crankcase for an internal combustion engine including a lubricant chamber for the collection of lubricant, and a bottom plate for providing dry sump lubrication closing the crankcase and being sealingly joined to the bottom end of the crankcase, wherein the crankcase includes auxiliary equipment comprising pumps for pumping lubricant into the lubricant chamber and from the lubricant chamber to various lubrication points, the bottom plate has a width exceeding the width of the crankcase so that it forms a section which is disposed outside the crankcase and auxiliary equipment is disposed on this section outside the crankcase.

The optimum construction space utilization is achieved in that the bottom plate has a width exceeding the width of the crankcase bottom side and auxiliary equipment is disposed on the top side of the bottom plate on a first section thereof which is outside the crankcase. For example, a heat exchanger and a filter may be arranged on the first section. Since the heat exchanger and the filter are closed components, no double wall structure is needed. In the remaining space above the heat exchanger and the filter a charge air cooler may be arranged. With this arrangement, a high packaging density is achieved for the given construction space that is the crankcase with the bottom plate, the heat exchanger, the filter and the charge air cooler occupy almost completely an available cuboid-shaped space next to the engine.

On a second section of the top side of the bottom plate, which is disposed within the crankcase, the pumps are arranged. Since the chamber at the bottom side of the crankcase is open, the pumps can be arranged on the top side of the bottom plate in such a way that they are arranged within the chamber. With the double wall structure, a lubricant release to the ambient is effectively prevented, that is, the operational safety is ensured.

In the bottom plate, the media flow channels, the lubricant storage chamber and the suction location for the pumps are disposed. By an integration of the fluid communication channels into the bottom plate, the number of seal structures of the crankcase is reduced. The auxiliary components are preassembled on the bottom plate so that they can be mounted to the bottom side of the crankcase together with the bottom plate in a single assembly step. This also improves the servicing capability. For the venting of the chamber, a channel extends from the geodetically highest point of the chamber to the suction sides of the pumps. Because of the high location of the suction location, a very good operating capability of the engine in an inclined position is achieved, it may be inclined for example up to 32" side inclination. An oil-air mixture in the vent channel is sucked out by the pumps whereby the oil discharge of an oil separator of the engine is reduced.

Below, a preferred embodiment of the invention will be described with reference to the accompanying drawings.

BRIEF DESCRIPTION OF THE DRAWINGS

FIG. 1*a* shows the section of the bottom plate.

DESCRIPTION OF A PARTICULAR EMBODIMENT

Figure 1:
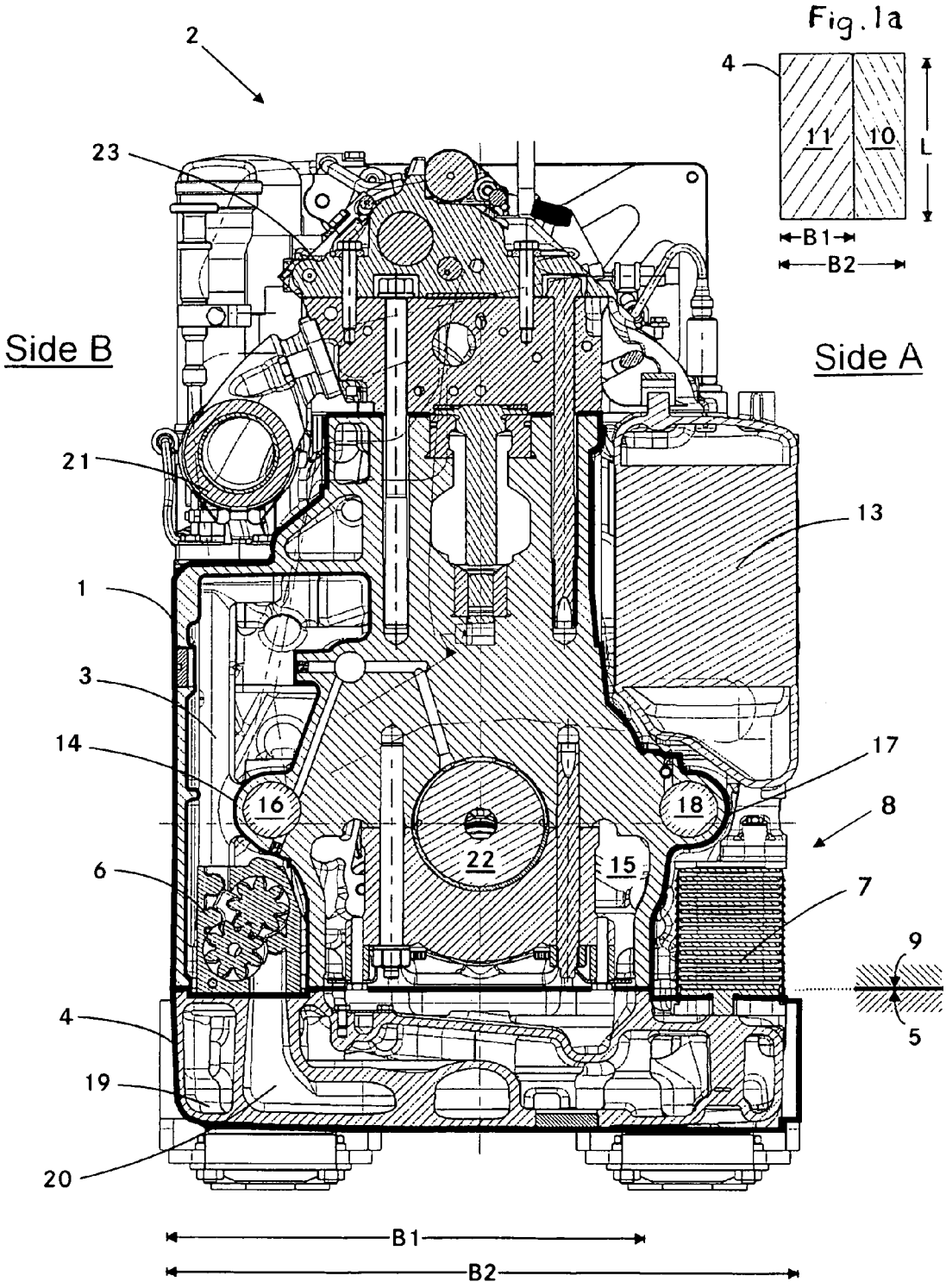
FIG. 1 shows the engine and the bottom plate in a cross-sectional view taken along a central plane.

FIG. 1 shows a first cross-sectional view of an internal combustion engine 2 with in-line arrangement of the cylinders which are vertically oriented. The engine 2 includes a crankcase 1 which is closed toward the ambient by a bottom plate 4. The bottom plate 4 has a top side 9 which abuts the underside 5 of the crankcase. Within the crankcase 1, there is a chamber 3 for collecting lubricant. As shown in FIG. 1, the chamber 3 is disposed on a B-side of the internal combustion engine 2. At the bottom side 5 of the crankcase, the chamber 3 is open.

The bottom plate 4 includes the channels for conducting fluids, suction locations for the pumps 6 and lubricant storage chambers. The reference numeral 29 for example designates such a lubricant storage space and the reference numeral 20 designates a suction channel which extends from a suction location (not shown) to the pumps 6. By way of the bottom plate 4, a dry sump lubrication system is provided.

In accordance with the invention, the bottom plate 4 has a width B2 which exceeds the width B1 of the crankcase bottom side 5. By the projection, that is, the difference B2 minus B1 between the bottom plate 4 and the crankcase 1 (FIG. 1*a*) the length L of the bottom plate 4 of the bottom plate 4 provides a first section 10 on the top side 9 of the bottom plate 4, which is disposed outside the crankcase 1. The width B1 of the crankcase 5 and the length L of the crankcase defines for a second section 11 on the top side 9 of the bottom plate 4, which is disposed within the crankcase 1. In the detail representation of FIG. 1*a*, the bottom plate 4 is shown schematically in a top view. As mentioned the first and second sections 10 and 11 are defined by the width B2−B1 and B1−and the length L of the crankcase 1. On the first section 10 of the bottom plate top side 9, a heat exchanger 7 and a filter 8 are arranged. In the sectional view of FIG. 1, the filter 8 is disposed behind the cross-sectional plane, that is, behind the heat exchanger 7. The heat exchanger 7 and the filter 8 are arranged outside the crankcase 1. Since both components are fluid-tight, a double wall structure is not needed, that is, they do not need to be arranged within the crankcase. The fluid supply structure and the fluid return structure to and from the heat exchanger 7 and the filter 8 are provided within the bottom plate 4.

In the space above the heat exchanger 7 and the filter 8, a charge air cooler 13 is arranged. This space on the A side of the internal combustion engine 2 is provided by the projection of the bottom plate 4 with respect to the second wall 17 of the crankcase 1 in the area of the cylinders and the length L of the crankcase 1. The pumps 6, that is, a suction and a pressure pump, are arranged on the bottom plate 4 in such a way that they are disposed within the chamber 3. In this way, a double wall arrangement is provided whereby lubricant leaking for example from a pump does not reach the ambient.

In FIG. 4, two optional counterweight shafts 16, 18 are shown. A first counterweight shaft 16 is arranged on the side B in a first wall 14 which delimits the chamber 3 with respect to a mechanism space 15 in which the crankshaft 22 is disposed. A second counterweight shaft 18 is disposed on the side A in the second wall 17, which delimits the mechanism space 15, on which the crankcase is disposed, with respect to the ambient. These optional counter weight shafts can be arranged within the crankcase 1 without requiring additional space. The number of counterweight shafts depends on the number of cylinders of the internal combustion engine.

The reference numeral 21 designates an exhaust gas duct which is arranged on the B-side of the internal combustion engine 2 outside the crankcase 1 in the area of the cylinders.

From the sectional view of FIG. 1, it is clearly apparent that the crankcase 1, the bottom plate 4, the heat exchanger 7, the filter 8, the charge air cooler 13, the exhaust gas duct 21 and the cylinder head 23 occupy a cuboid space almost completely. The arrangement therefore has a high packaging density. With the integration of the fluid ducts into the bottom plate 4 and the arrangement of the auxiliary equipment on the bottom plate 4, a simple assembly with good servicing accessibility is achieved.

Figure 2:
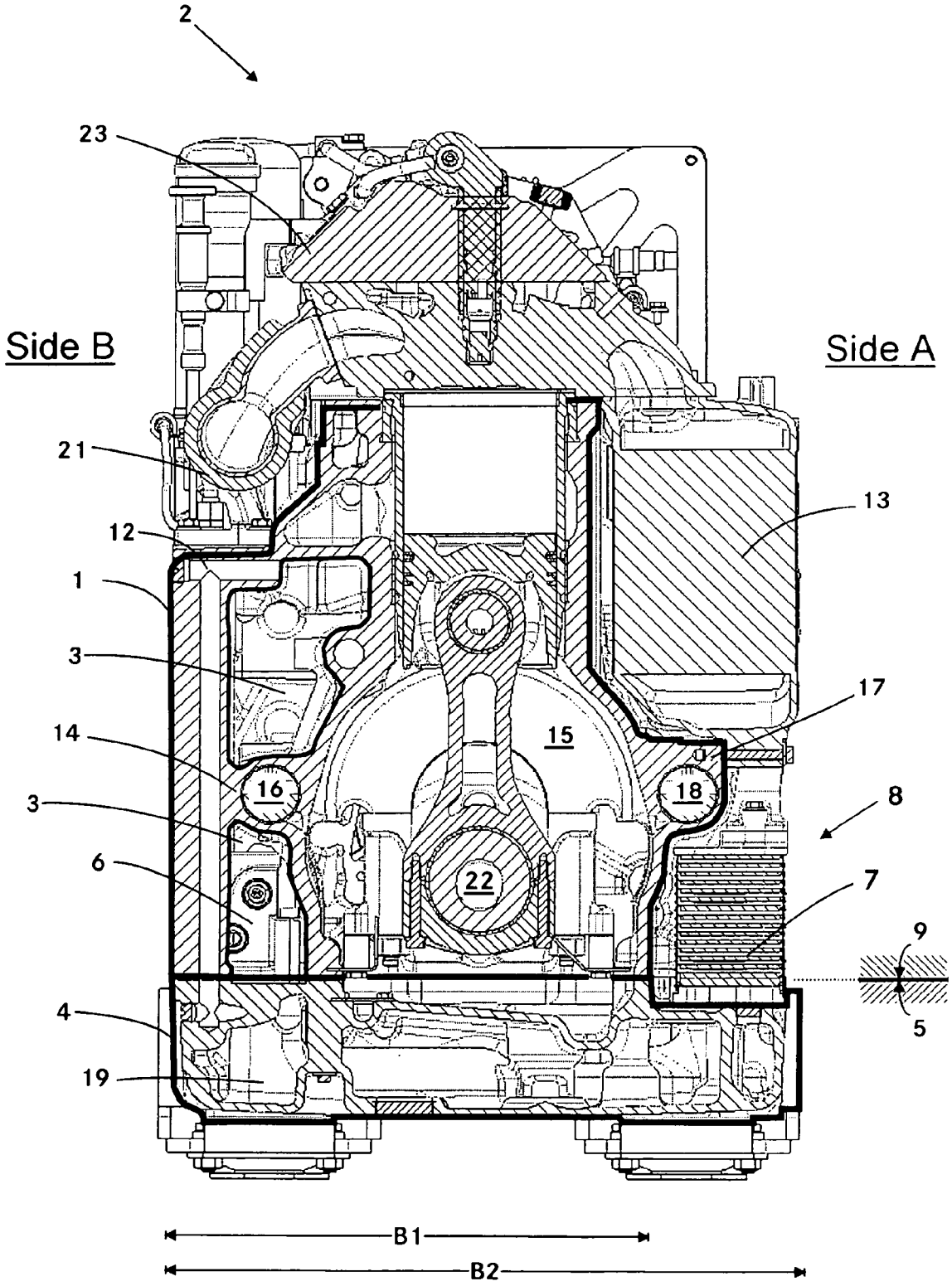
FIG. 2 shows the engine and the bottom plate in a cross-sectional plane taken along a second plane spaced from the central plane.

FIG. 2 shows the internal combustion engine 2 in a second cross-sectional plane. The same reference numerals are used as in FIG. 1. In this cross-sectional view a venting passage 12 is visible which extends from the highest point of the chamber 3 on the suction side of the pumps 6 to the bottom plate 4. With this arrangement, the engine can be operated in a highly inclined position of for example 32° without any lubricant being released from the crankcase 1. The functionality is the same as described in connection with FIG. 1.

The arrangement according to the invention has the following advantages:

- in comparison with the state of the art, a high packaging density is obtained, that is, a given construction space is better utilized,
- a double-wall arrangement for the heat exchanger and the filter is avoided,
- with the venting passage and the vacuum the engine can be operated in a highly inclined position,
- the arrangement of the counterweight shafts within the crankcase requires no additional construction space,
- the bottom plate and the auxiliary equipment can be pre-assembled and mounted fully assembled to the bottom side of the crankcase whereby engine assembly expenses are reduced,
- an oil air mixture in the venting passage is sucked out by the pumps whereby the oil collection in an oil separator of the internal combustion engine is reduced.

What is claimed is:

1. A crankcase (1) for an internal combustion engine (2) with in-line cylinder arrangement, said crankcase (1) including a chamber (3) for the collection of lubricant disposed within the crankcase (1), a bottom plate (4) for providing a dry-sump lubrication and being mounted to the crankcase (1) for closing the crankcase (1) with regard to the ambience, the bottom plate (4) having a top side (9) sealingly joined to a bottom side (5) of the crankcase (1) and including auxiliary equipment comprising pumps (6) for pumping lubricant into the chamber (3) and for pumping lubricant out of the chamber (3) to various lubrication points of the internal combustion engine (2), said bottom plate (4) having a width (B2) exceeding the width (B1) of the bottom side (5) of the crankcase (4) so that it extends sidewardly beyond the crankcase (1), said bottom plate (4) forming a first section (10) on the bottom plate topside (9) which is disposed outside the crankcase (1) and on which auxiliary equipment is mounted outside the crankcase (1).

2. A crankcase (1) with a bottom plate (4) according to claim 1, wherein a heat exchanger (7) and a filter (8) are disposed on the first section (10) of the top side (9) of the bottom plate (4).

3. A crankcase (1) according to claim 2, wherein the pumps (6) are arranged on a second section (11) of the bottom plate topside (9) which is disposed within the crankcase (1).

4. A crankcase (1) according to claim 3, wherein the chamber (3) is open at the crankcase bottom side (5).

5. A crankcase (1) according to claim 4, wherein the pumps (6) are disposed on the bottom plate top side (9) in the second section (11) within the chamber (3).

6. A crankcase (1) according to claim 5, a vent passage (12) for venting the chanter (3) extends from the highest point of the chamber (3) to a suction channel (20) of the pumps (6).

7. A crankcase (1) according to claim 1, wherein channels for lubricant and coolant, suction locations for the pumps (6) and lubricant storage chambers (19) are arranged in the bottom plate (4).

8. A crankcase (1) according to claim 1, wherein in a remaining space above the first section (10) of the bottom plate top side (9) a charge air cooler (13) is arranged.

9. A crankcase (1) according to claim 1, wherein in a first wall (14) which delimits the chamber (3) with respect to the drive mechanism space (15), a first counter weight shaft (16) is disposed.

10. A crankcase (1) according to claim 9, wherein, additionally, in a second wall (17) which delimits the drive mechanism space (15) toward the ambient a second counterweight shaft (18) is disposed.

* * * * *